United States Patent [19]

Gonsalves et al.

[11] 4,107,889

[45] Aug. 22, 1978

[54] FOUNDATION SYSTEM

[75] Inventors: Mathew W. Gonsalves, Concord; Carlos P. Murillo, Walnut Creek, both of Calif.

[73] Assignee: Gonsalves, Santucci, Inc., Concord, Calif.

[21] Appl. No.: 748,842

[22] Filed: Dec. 9, 1976

Related U.S. Application Data

[63] Continuation-in-part of Ser. No. 662,491, Mar. 1, 1976, abandoned.

[51] Int. Cl.[2] ..... E04B 1/16

[52] U.S. Cl. ..... 52/259; 52/299; 52/295

[58] Field of Search ..... 52/283, 292, 297–299, 52/704, 295, 259, 583, 587, 432

[56] References Cited

U.S. PATENT DOCUMENTS

| | | | |
|---|---|---|---|
| 1,075,368 | 10/1913 | Miller | 52/264 |
| 1,091,168 | 3/1914 | Sanquist | 52/704 |
| 2,616,284 | 11/1952 | Leontovich | 52/295 |
| 2,780,935 | 2/1957 | Rumble | 52/742 |
| 2,948,995 | 8/1960 | Cogan | 52/587 |

FOREIGN PATENT DOCUMENTS

| | | | |
|---|---|---|---|
| 264,091 | 11/1967 | Austria | 52/587 |
| 642,707 | 9/1950 | United Kingdom | 52/295 |
| 41,969 | 10/1965 | Fed. Rep. of Germany | 52/259 |

*Primary Examiner*—James L. Ridgill, Jr.

*Attorney, Agent, or Firm*—Townsend and Townsend

[57] ABSTRACT

A foundation for supporting a superstructure in which the foundation comprises precast concrete beams mounted on and supported by at least two non-precast pier elements. Each of the pier elements is poured in place in specially formed vertical holes in the ground at the construction site and have an axially aligned reinforcing rod which extends upward above the top of the pier. Each precast beam has at least two spaced-apart apertures which overlie the respective pier elements. In one embodiment, these apertures receive the reinforcing rods of the pier elements when the beam is mounted upon the piers during construction, and cementing material is introduced into each aperture to effect a bond between the beam and each pier element associated therewith. Each precast beam is thereby supported in an upright position with the beam parallel to the ground. In another embodiment, a tubular pedestal is affixed to the top of the pier and the reinforcing rod of the pier extends into but not above the tubular pedestal. The beams are mounted on the pedestal with a beam aperture positioned above each pedestal and a second reinforcing rod is inserted into and positioned to extend between each beam aperture and its associated pedestal. A cementing material is introduced into the sleeve aperture and pedestal to bond each beam and pier elements associated therewith together. It is preferred that hollow sleeves be used to define each of the apertures formed in the beams.

5 Claims, 9 Drawing Figures

FOUNDATION SYSTEM

This is a continuation-in-part of prior co-pending application Ser. No. 662,491, filed Mar. 1, 1976 now abandoned.

This invention relates to support foundations for superstructures and in particular applicable to housing foundations.

Heretofore, foundations for such structures as houses and the like are constructed, in many instances, using the "pour-in-place" technique. Accordingly, a trench is dug in the ground which generally follows the outline of the foundation to be constructed. Wooden forms are then built within the trench with side braces for lateral support of the form walls, which will be used to hold and shape the concrete during the curing process. Steel reinforcing rods are put in the forms to provide structural support. The concrete is then prepared and poured into the forms. A waiting period follows to allow the concrete to cure. Finally, the forms are dismantled leaving the upright foundation ready for receiving a structure thereon.

While satisfactory in some respects such "pour-in-place" techniques for constructing a foundation are not without certain troublesome disadvantages. For example, digging the trench, building the forms, placing the reinforcing rods in the forms, and pouring the concrete require a certain amount of time and energy to be expanded; such time and energy can and often does add considerably to the cost of construction. Moreover, the curing process, which is dependent upon prevalent weather conditions, can unduly lengthen construction.

Further, pour-in-place foundations may be constructed by workmen who may be careless or possess limited experience. The result can be a foundation that is of poor quality and/or has used an excess amount of material due to spillage and the like.

Once the poured concrete foundation has cured, the forms must be dismantled, thereby requiring additional time before construction of the superstructure is started. In short, a substantial amount of time and manpower is consumed at the construction site to construct a foundation before any construction of the superstructure can commence.

Moreover, the walls or beams of such foundations usually set directly upon the ground. In some areas, the soil will expand and contract in accordance with the prevailing weather conditions, causing such a foundation, and the structure or portions thereof supported by the foundation, to move. Such movement, in turn, can result in cracks in the foundation itself and damage to the superstructure.

Finally, the construction industry has long been aware of the use of prefabricated elements, such as walls, beams and the like, to minimize certain construction costs. Also, foundation piers have been made in prefabricated form and then put in place either by pounding the beam into the ground or by some other method. However, this technique is very time-consuming and requires specialized equipment and is not feasible for housing construction.

BRIEF SUMMARY OF THE INVENTION

According to the present invention, therefore, many of these disadvantages are overcome by providing a foundation which reduces much of the time and effort heretofore required for foundation construction. The foundation of this invention comprises precast concrete foundation beams adapted to be supported in a predetermined position, horizontal to the ground, by vertically disposed concrete pier elements which are poured in place at the construction site in specially formed vertical holes in the ground. Each precast beam has a number of apertures spaced so that each aperture will overlie a pier element.

In the first embodiment of the foundation, the pier elements are formed by being poured in place in the holes with longitudinal and axially aligned reinforcing rods therein extending out of and above each pier element and the ground. The top of each pier element extends a short distance above the ground and is provided with a flat horizontally disposed top. After the pier elements have curved, the beams are mounted upon the pier elements with the beam apertures receiving the vertically extending reinforcing rods of each pier element. The beam, when set upon at least two pier elements with the reinforcing rods situated in apertures of the beam, is thereby held in a predetermined position, oriented with the larger sectional dimension generally vertical. A bonding material is then inserted in each aperture to bond the foundation wall to the vertically extending reinforcement rods of each pier element.

It is preferred that the beams be provided with a number of spaced, transverse hollow sleeves which form the beam apertures. Each sleeve has a set of tabs which form, with the sleeve, U-shaped, vertically upward opening holders that function to hold the beam reinforcing rods in spaced, parallel relation during beam fabrication. Side walls of the sleeve are provided with a number of outward extending ribs which function to secure each sleeve within the precast beam.

A primary advantage of the sleeve construction described above is that the sleeve obviates the wire stirrups and other apparatus normally required to appropriately position the reinforcement bars within the beam form during beam fabrication. Additionally, the ribs also form indentations in the inner surfaces of the sleeve side walls to aid in providing a purchase for beam lifting and handling apparatus. These features and advantages will be more fully understood when further explained below.

A second embodiment of the present invention includes a tubular pedestal mounted to the uppermost surface of the pier element and generally coaxial therewith. The pier reinforcement rod extends out of the top of the pier and into but not above the pedestal. The piers are usually poured so that the tops are at or a litle below ground level. Before the piers have cured, the tubular pedestal, which is of a diameter less than the pier, is set on top and generally coaxially aligned with each pier. The pedestals of the entire foundation are then vertically adjusted so that their tops are planar.

The bleams are set upon the pedestals so that each beam aperture overlies a pedestal. A second reinforcing rod is inserted into each beam aperture (formed with or without a sleeve) and into the interior of the pedestal beneath and situated so that it extends into and between each aperture and pedestal therebeneath. A bonding material is then introduced into the beam aperture and the interior of the tubular pedestal to thereby bond each pier element to the beam.

The foundation system of the present invention permits the utilization of the advantages of precast concrete beam construction in foundation systems for relatively small structures such as houses. The pier elements of the foundation are poured in place in holes formed in the ground, eliminating the difficulties encountered when precast elements are used as the pier elements. Yet, the present invention allows for the use of precast concrete beams as the overlying elements of the foundation. The present invention provides a system and method for joining the precast concrete beams to the piers so that a secure foundation is erected.

The formation of poured-in-place pier elements at the construction site is extremely simple and relatively inexpensive. Holes are simply drilled in the ground where the pier elements are to be placed, and the concrete is poured into these holes. The difficulty with poured-in-place construction arises when the upper level of the foundation, namely the beams overlying the pier elements, are to be poured in place on site. All of the added expenses and difficulties associated with construction of forms and the like associated with this technique are minimized or eliminated with the present invention by using precast concrete beams, which can be constructed in a factory environment at relatively low cost.

In the first embodiment of the present invention, an adequate technique is provided for joining the precast concrete beams to the pier elements. However, in the first embodiment, the reinforcing rod extending upwardly from the pier element must be located with some precision so that it engages the aperture in the overlying beam when the beam is properly aligned in its intended position. Another difficulty with the first embodiment is that the upper surfaces of the pier elements must be in a common plane so that the foundation is level. Proper alignment of the reinforcing rods and leveling of the upper surfaces of the pier element is difficult to achieve in field construction.

The second embodiment is preferred over the first embodiment because the problems of aligning the reinforcing rod with the aperture in the beam and leveling the top of the piers are minimized or eliminated altogether. Since the reinforcing rod of the pier itself does not extend above the top of the tubular pedestal in the second embodiment, alignment of the pier element with the aperture is effective as long as the aperture overlies the interior of the element, which is not a problem even in field construction. A second reinforcing rod is merely inserted through the aperture and into the interior of the tubular pedestal to effect the necessary reinforcement overlap. The tubular pedestals are embedded into the tops of the piers while they are curing, and only the pedestals themselves need be leveled, which is not a difficult task and can readly be achieved in the field.

It can be seen that large amounts of time can also be saved, when constructing support foundations, through the use of the present invention. The construction, and subsequent dismantling, of forms for the foundation walls are no longer required. The time required for pouring the concrete into the foundation wall forms is deleted. Finally, very little time is lost in waiting for concrete of the pier elements to gain strength before continuing construction; and no such time is lost so far as the foundation wall is concerned.

Since the tops of each pier element on the pedestal, if used, upon which the precast foundation beam is mounted, is situated above the ground, the beams are removed from the effects of expanding soil. The effect of soil expansion upon the pier elements themselves has been found to be minimal.

Finally, precast units can be standardized. Savings can then result from repeated reuse of forms and assembly line production. Furthermore, high quality can be maintained because of the controls that can be kept on production under plant conditions.

DETAILED DESCRIPTION OF THE PREFERRED EMBODIMENT

Figure 3:
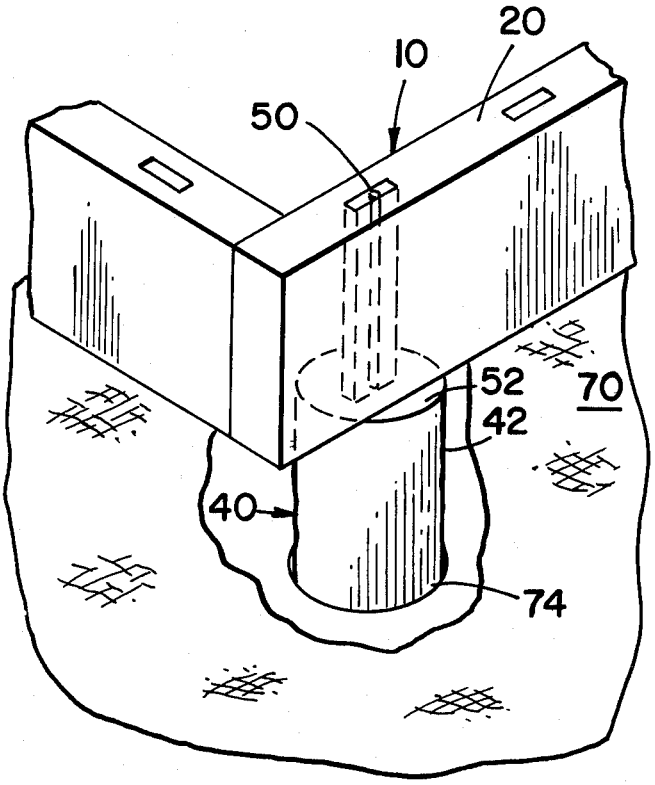
FIG. 3 is a perspective view of a portion of a foundation constructed in accordance with the first embodiment illustrating placement of the pier elements in the ground and the precast beams situated thereon.
Figure 4:
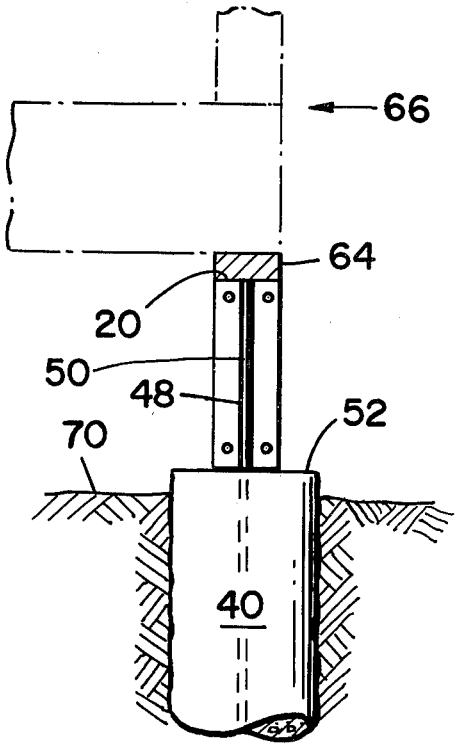
FIG. 4 is a cross-sectional view of a pier element with a precast beam placed thereon.
Figure 5:
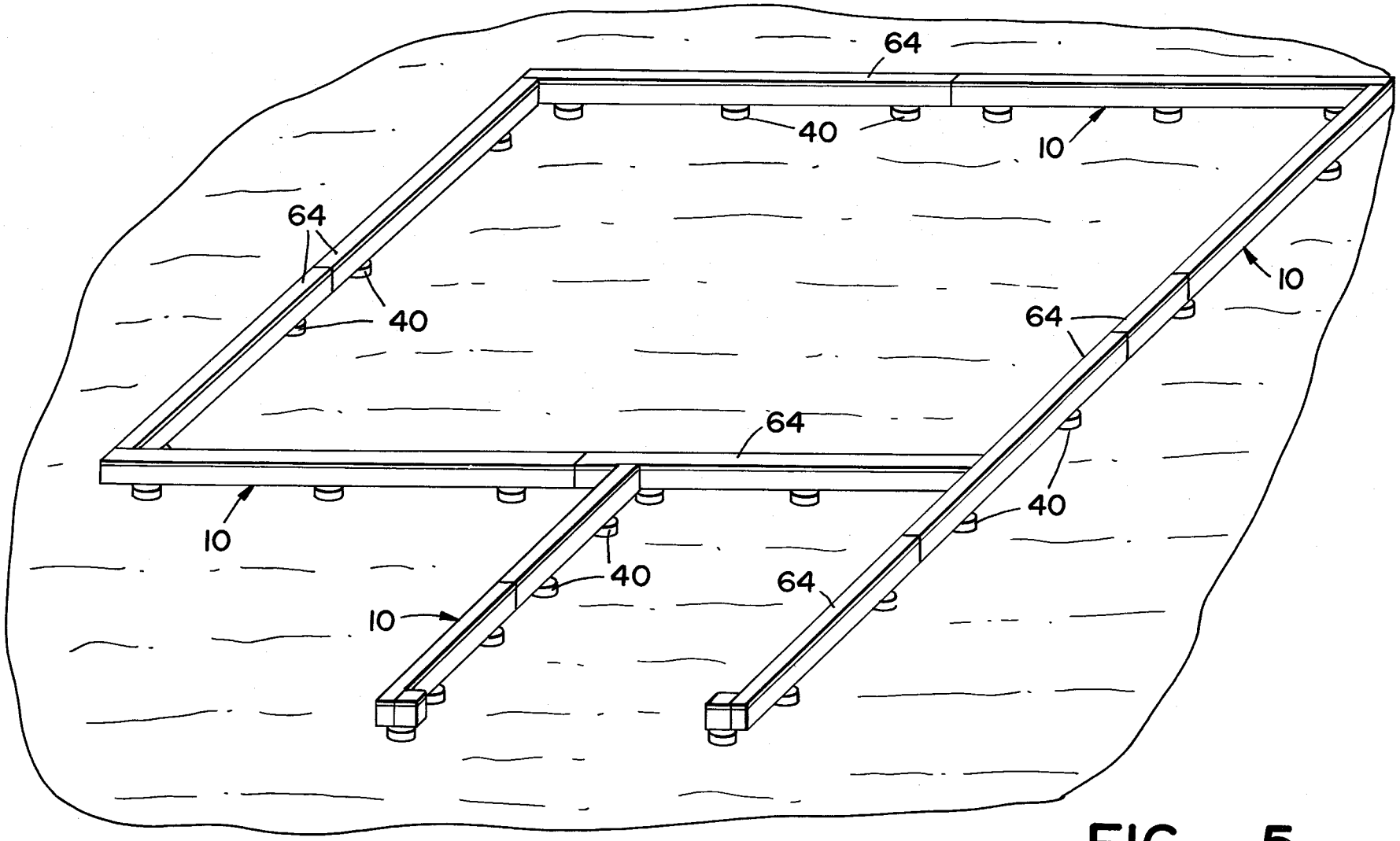
FIG. 5 is a perspective view illustrating a constructed foundation of the present invention.

Referring to FIGS. 1–5, and particularly with reference to FIG. 5 illustrating a perspective view of a constructed foundation, beams 10 are shown mounted upon pier elements 40. In the first embodiment, pier elements 40 are poured in place in holes 74 which form a generally cylindrically shaped pier element, vertically disposed in the ground with a flat top 44 extending above the ground. Reinforcing rod 50, used in construction of the pier element, is allowed to extend above top 44. After construction of pier elements 40, precast concrete beams 10, having apertures 26 for receiving the rods 50, are mounted thereon as shown. An appropriate bonding material is introduced into apertures 26 to effect a secure bond between the beams 10 and the rods 50 of the pier elements 40.

Figure 1:
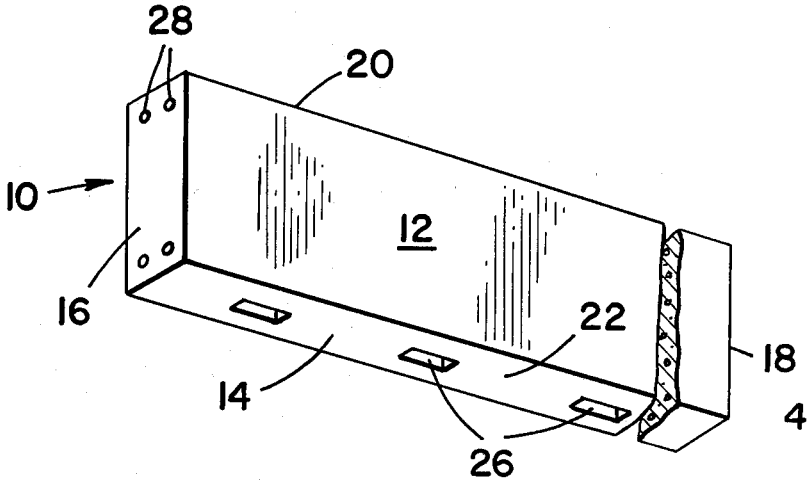
FIG. 1 is a perspective elevated view of a wall constructed according to a first embodiment of the present invention.

For illustrative purposes, the beams of FIG. 1–4 are drawn somewhat out of proportion. In contemplated use as foundations for residential structures, beams 10, as FIG. 5 illustrates, are much longer and thinner in construction. Referring now to FIG. 1, the first embodiment of the precast beam of the present invention may now be described. Beam 10 is generally rectangular in section, having planar surfaces 12 and 14 spaced opposite one another by a predetermined thickness. Bordering each surface 12, 14 are elongate sides 20 and 22 each terminating in ends 16 and 18. Midway between planar surfaces 12 and 14, extending between sides 20 and 22, are generally rectangular apertures 26. Longitudinal reinforcing rods 28 are shown embedded in the beam 10 to provide reinforcing and structural support for the material used to construct beam 10. Reinforcing stirrups or ties (not shown) are provided, attached to the reinforcing rods 28, to hold the rods in spaced relation while beam 10 is being constructed.

Figure 2:
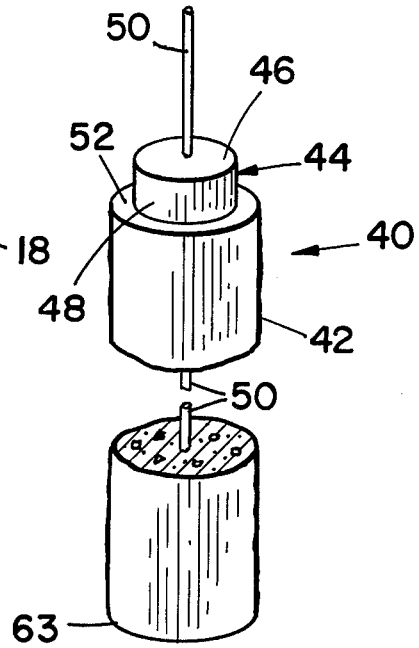
FIG. 2 is a perspective view of the pier element of the first embodiment of the present invention.

In FIG. 2 there is shown pier element 40 upon which beam 10 is to be mounted to construct a foundation. Pier element 40 is provided a generally cylindrical elongate body 42 surrounding an axially aligned reinforcing rod 50. Reinforcing rod 50 is of sufficient length to extend above top surface 52 of the pier element (FIGS. 3 and 4).

Pier element 40 may be constructed at the work site by cast-in-place techniques. A generally vertical hole 74 (FIG. 3) is formed in the ground and reinforcing rod 50 centrally disposed therein. A form (not shown) is constructed about the hole at ground level. The material used to construct pier element 40 is poured into the form (not shown) and hole 74 to thereby create an elongate generally cylindrically shaped pier element having a top surface 52 situated above the surface of the ground (FIGS. 3–5).

At times, for the sake of appearance, the pier elements of this invention may be provided with a pedestal. Thus, in FIG. 2 pier element 40 is provided with pedestal 44 having a smooth, eye-pleasing surface 48 and top surface 46 adapted to have mounted thereon beam 10. Additionally, the pier elements may be provided a tubular pedestal (FIGS. 8 and 9) on an alternate embodiment of the present invention. This latter aspect of the present invention will be dealt with more fully below.

The top surface 52 of pier element 40, or top 46 if pedestal 44 is formed, is flat so that when rod 50 is inserted in an aperture 26 of wall member 10, a level surface is provided side 20 or 22.

The longitudinal and upright dimensions of wall member 10 will vary depending upon the particular dimensions of the superstructure and the configuration and surface condition of the ground upon which the foundation is placed. It is contemplated, in foundations for residential housing, that the thickness of beam 10 need not exceed 6 inches; the concrete used to construct the precast beams 10 and pier elements 40 preferably will have a minimum ultimate compressive strength of 2500 p.s.i. at 28 days. If another material is used, comparable qualities are contemplated for residential structures.

The pier element 40 will have a length and diameter which will vary according to the conditions of the soil in which the pier is used. These dimensions are easily determined by those skilled in the art of foundations and are dependent upon such factors as soil make-up, size and weight of the structure to be supported by the foundation and, in some cases, the weather conditions. For example, for stiff, natural clays, as found in certain areas of California, the body 42 of pier element 40 will be approximately 12 inches in diameter and 8 feet in length.

It is presently contemplated, for residential housing foundations, that reinforcing rods 28, used in beam 10 are number 4 rods with number 2 ties (not shown) spaced 18 inches apart. Reinforcing rod 50, used in pier element 40, is preferably a number 5 reinforcing rod of sufficient length to extend from base 63 of the pier to a point above top surface 52. The length of rod 50 extending above surface 52 is approximately equal to the length of aperture 26 of beam 10.

Referring now to FIGS. 3–5, the method by which wall members 10 and pier elements 40 are used to construct a foundation may now be described. First, the area which will be circumscribed by the foundation is prepared by some excavation so that the ground 70 that will lie within and about the foundation is somewhat level. Next, pier holes 74 (FIG. 3) are formed along the periphery of the foundation. The spaced intervals at which pier holes 74 are placed are, of course, determined by the spacing between apertures 26 in wall member 10. The depth of each pier hole 74 is dictated by the soil conditions of the area as described above. Pier elements 40 are then constructed in each pier hole 74, as described above, with or without pedestal 44.

With pier elements 40 appropriately constructed, beams 10 are placed thereon so that rods 50, of each pier element, are contained within each respective aperture 26 of the beams. Each aperture is then filled with appropriate material to effect secure bonding between the beam and rod 50 of each respective pier element 40. A wood sill 64 may then be bolted or otherwise anchored to the uppermost side 20 of each beam 10 (FIG. 4). Sill 64 may then be used to attach the remainder of the superstructure 66 to the foundation.

The precast beam 10 of the present invention may be fabricated from concrete or the like using, for example, a reusable form (not shown) constructed from parallel, spaced-apart sidel walls attached to a bottom wall, thereby forming a U-shaped channel that opens upward. The spacing of the side walls, as well as their vertical height above the bottom wall would, of course, depend upon the dimensions of the beam to be fabricated therein. Prior to introducing the concrete or other material used to fabricate the beam into the form, reinforcement bars 28 are placed therein. The reinforcement bars are held in spaced-apart, parallel relation, relative to one another, by a number of wire stirrups (not shown). Further, the reinforcement bars themselves are appropriately positioned and held vertically within the form by a number of wire stands (not shown) that hold the bars a predetermined distance above the bottom wall of the form. Properly applying the stirrups and stands can, at times, take a large amount of time, particularly if the precast beam is of substantial length.

Figure 6:
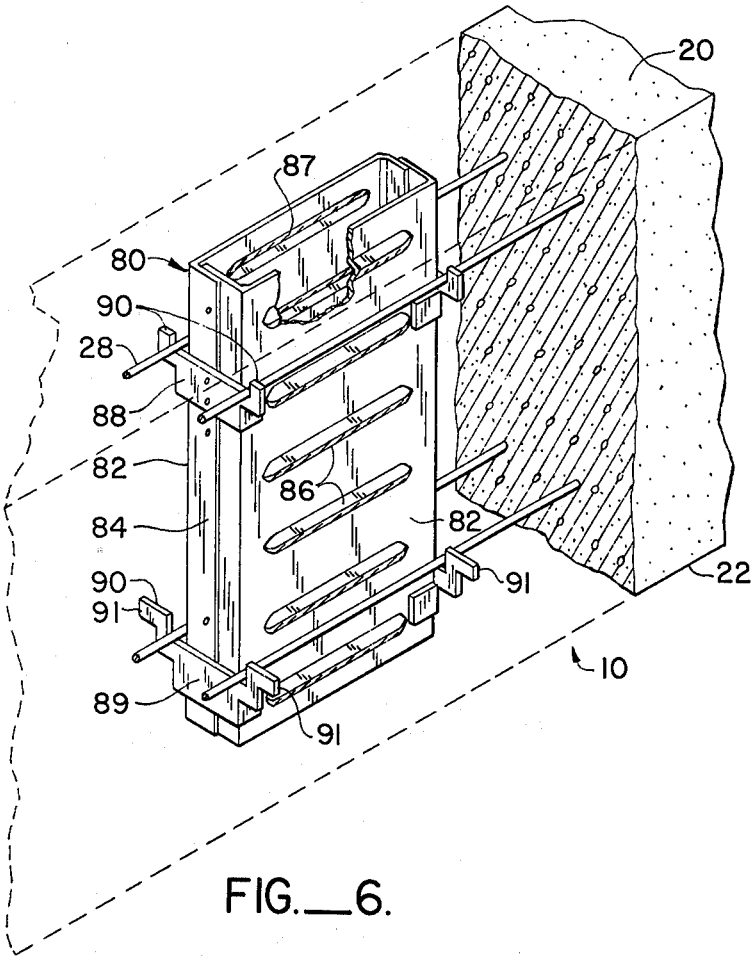
FIG. 6 is a partial perspective elevated view of a beam, partly in section, illustrating a sleeve used to form apertures in an alternate embodiment of the precast beam of the present invention.
Figure 7:
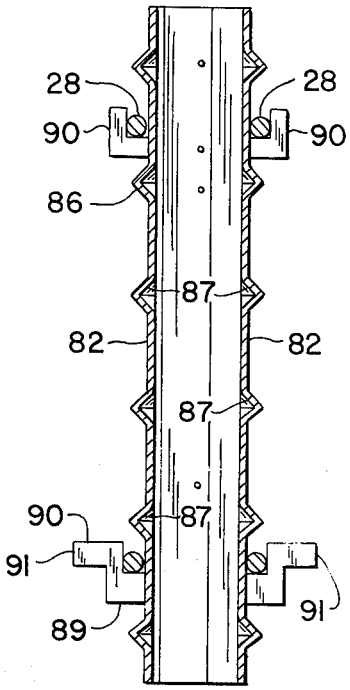
FIG. 7 is a cross-sectional end view of the sleeve illustrated in FIG. 6.

Therefore, an alternate construction of the precast beam 10 of the present invention is provided which obviates such use of stirrups and wire stands for proper placement of the parallel reinforcement bars during fabrication of the beam. Referring now to FIGS. 6 and 7, which illustrate a second embodiment of the present invention discussed in more detail hereinbelow, the alternate construction of beam 10 is shown as including a hollow sleeve 80 that extends between top and bottom sides 20 and 22, respectively, to define aperture 26. Sleeve 80 is shown as being defined by side walls 82, which lie generally parallel to the beam longitudinal, interconnected by end walls 84.

Formed or stamped in the side walls 82 are outward extending ribs 86 which function to hold sleeve 80 within the precast beam after the concrete or other fabrication material has cured; that is, ribs 86 provide additional holding surface area for sleeve 80 for adherence of the concrete thereto, as well as increasing the resistance of the sleeve from being torn out of the beam for one reason or another.

Viewed from the interior of sleeve 80, ribs 86 form recesses or cavities 87 in interior surfaces of side walls 82 of the sleeve. As can be seen more particularly in FIG. 7, ribs 86, and therefore, cavities 87, are formed so that the cavities of one side wall 82 are in opposing relation to the cavities of the remaining side wall. So formed and positioned, cavities 87 can be adapted to form a purchase for receipt of special attachment apparatus (not shown) to allow the beam to be attached to lifting and handling machinery. Additionally, cavities function to increase adherence with the sleeve of the cementing material inserted into the sleeve to bond the beam to an underlying pier.

Securely affixed to end walls 84 are upper and lower support tabs 88 and 89, respectively which function to support reinforcement bars 28 during fabrication of the precast beam. The support tabs are appropriately placed, relative to the sleeve, so that each tab forms a pair of generally U-shaped bar supports with the sleeve side walls 82 which are adapted to receive and hold reinforcement bars 28, as shown in FIGS. 6 and 7. Further, tabs 88 are positioned, with respect to the top and bottom peripheries of sleeve 80, so that reinforcement rods 28 will be held at an appropriately predetermined vertical location within the form during beam fabrication.

In use, sleeve 80 would be vertically situated in a form used to fabricate the precast beam of the present invention, constructed generally in accordance with that outlined above. In this regard, it is to be noted that each lower support tab 89 has a pair of vertical extentions 90 that project away from the tab. The end tips 91 of each extension pair are spaced sufficient distance apart from one another so that the tabs, and therefore the lower end of sleeve 90, is positioned mid-way between the longitudinal side walls of the form. The end of sleeve 80 proximate upper support tabs 88 is positioned and held intermediate the form side walls by a cap (not shown) that has a short, downward depending rectangular stub that snugly fits into aperature 26. The cap (not shown) tips engage the form side walls to properly position the cap and, therefore sleeve 88 in which it is inserted, within the form.

A number of sleeves would be appropriately positioned along the longitudinal of the form to define the plurality of apertures with a predetermined spacing. The reinforcement bars 28 would then be set within the hook-like rests, defined by the support arm 90 and the sleeve, thereby holding the reinforcement bars in parallel, spaced relation to each other as well as to the precast beam to be fabricated. Concrete or the like may then be poured into the form about the sleeves and allowed to cure.

The second embodiment of the present invention concerns an improvement in the attachment of beam 10 to the respective piers 40. The invention, as described thus far, requires pier holes 74 to be drilled in the ground 70 (FIG. 3) at relatively exact locations so that the reinforcement rods 50, which extend above the piers, can be properly received by the apertures 26 of each beam 10. However, it has been found that occasionally the terrain and other factors can make such exact positioning of holes 74 extremely difficult. Also, the upper surfaces of the piers must be level which is also difficult. Therefore, an additional embodiment of the present invention provides apparatus for connecting a number of piers 40 to a beam 10 which allows for a certain amount of misalignment that may arise during drilling of pier holes 74 and simplifying the leveling of the surfaces on which the precast beams are located.

Figure 8:
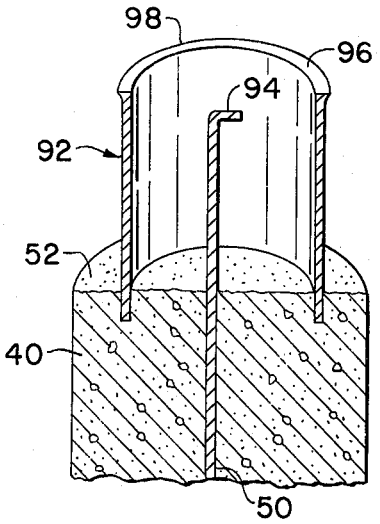
FIG. 8 is a cross-sectional perspective view of the top portion of an alternate embodiment of the pier element of the present invention showing a tubular pedestal affixed thereto.
Figure 9:
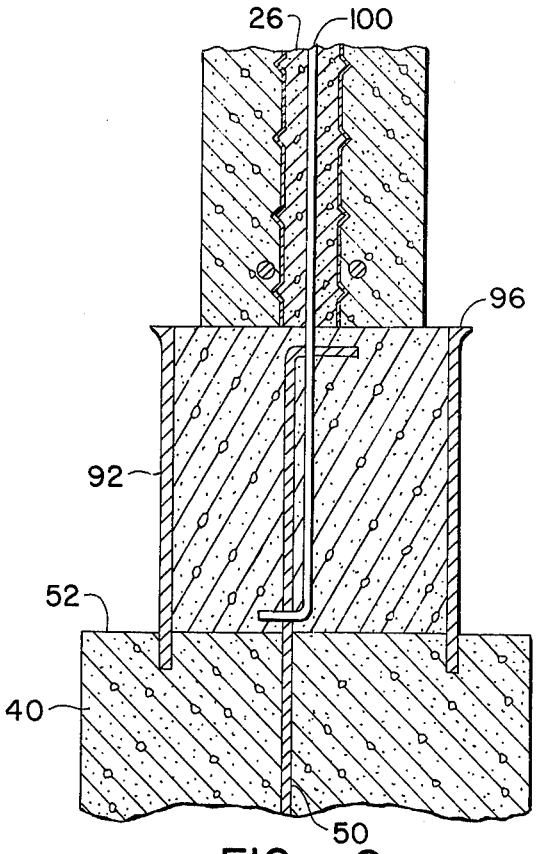
FIG. 9 is a cross-sectional view of a pier element with a precast beam placed thereon.

Referring now to FIGS. 8 and 9, pier 40 is shown as including a hollow tubular pedestal 92 disposed on the top surface of and generally coaxial with the pier. The upper periphery 96 of the pedestal is formed to define lip 98. The reinforcement rod 50 of the pier of this embodiment continues to extend out of and above the top pier surface 52. However, the uppermost end of the reinforcement rod 50 is provided with a 90° bend to form a short horizontal extension 94. Moreover, the length of reinforcement rod 50 is such that the end extension 94 of the bar is situated approximately one inch below the upper periphery 96 of the tubular pedestal 92.

When beam 10 is mounted upon at least two of the piers, a connector rod 100 is inserted through aperture 26 so that the rod extends from the aperture into the tubular pedestal. The connector rods provide connective and adhesive support between the beam and the pedestal in combination with a cured bonding material 106 that is introduced into aperture 26 and tubular pedestal 94 which are in communicating relation.

Use of this particular embodiment of the present invention also begins with preparation of the building site by some excavation and the drilling of the pier holes, as discussed above. The pier elements 40 are then constructed in each pier hole by pouring in place concrete or the like. Reinforcement bar 50 may be placed in the pier hole prior to pouring the concrete or, alternatively, may be inserted into the wet concrete of the pier element. While the pier element material is still wet, the tubular pedestal 92 is placed on and forced into the top surface 52 of the pier so that, when cured, the pedestal will be securely affixed to the top 52 of the pier. Before the piers cure, however, the top peripheries 96 of all pedestals are adjusted, by the use of string lines, laser devices, or the like, so that they are coplanar.

Once the piers 40 have cured, beams 10 are mounted so that the apertures 26 of the beams generally overlie and communicate with pedestals 92. A connector rod 100 is then inserted through each aperture 26 of each beam and positioned to extend essentially the length of aperture 26 and depth of pedestal 92 as illustrated in FIG. 9.

A bonding material, such as grout or the like, is then introduced into aperture 26 so that the interior of tubular pedestal 94, as well as aperture 26, are filled. When cured, the bonding material securely adheres to the connector rod 100 as well as the beam and the pedestal to effect a secure bond therebetween. As previously discussed, a wood sill 64 may then be bolted or otherwise anchored to the uppermost side 20 of the vertically disposed beam for the remaining construction of the superstructure.

In order to provide maximum vertical as well as upright support for beams 10 in residential construction, it is contemplated that the spacing of apertures 26, and therefore pier elements 40 when situated in the ground, should be no more than ten feet apart. Moreover, an aperture 26 should be located no further from end 16 (or end 18) than four feet.

Finally, the present invention permits the placement of beams 10, either end-to-end or at the corners, to merely be butt-tight. Sincel movement of the foundation, from soil expansion, is minimized, the need to joint foundation ends or corners is obviated. This can be, as can easily be seen by one skilled in the art of constructing foundations, an extremely time-saving feature.

It is evident, therefore, that the subject invention provides foundation elements which may easily and simply be prefabricated and used to construct the foundation of a house or similar structure.

Although a preferred embodiment of the foregoing invention has been described in some detail by way of illustration and example for purposes of clarity of understanding, it will be obvious that certain changes and modifications may be practiced within the scope of the appended claims. For example, while the preferred embodiment disclosed straight precast beams, the beams could be curved and, therefore, used in structures having curvilinear foundations. Further, the pier elements themselves could be precast, rather than cast-in-place. Accordingly, the intent is to embrace all such alternatives, modifications, and variations as fall within the spirit and broad scope of the appended claims.

We claim:

1. A foundation for supporting a building upon a ground surface, the foundation having a number of sections, each section comprising:

at least two vertically elongate concrete pier elements poured in place in holes of predetermined dimensions formed in the ground, each of the pier elements having an uppermost end and at least one axially aligned reinforcing element extending upwardly out of the uppermost end;

at least two pedestals each of the pedestals having an internal surface defining a hollow interior with opposed open ends, one said open end affixed to the uppermost end of a corresponding one of the pier elements, the reinforcing rod extending into the pedestal and terminating at a location intermediate the opposed ends of the pedestal, said other open end disposed above the pier element;

an elongate precast concrete beam placed on at least two of the pedestals and having a parallel transverse aperture vertically disposed in generally overlying relation to a corresponding one of the respective pedestals therebeneath, the minimum distance between opposing portions of the internal surface of each pedestal being substantially greater than the cross-sectional area of each aperture; and connecting means disposed interior of and extending between each of the apertures and extending into the pedestal therebeneath to connect each pier element to the beam and hold the beam in a predetermined relation with respect to the ground surface, the connecting means including a reinforcing element situated interior of and extending between each aperture and pedestal therebeneath and a bonding agent occupying the interior of each aperture and underlying pedestal.

2. The foundation of claim 1, wherein each of the pier elements is generally cylindrical in shape.

3. The foundation of claim 1, wherein each of the beams has a generally rectangular section.

4. The method of constructing a support foundation adapted to support a superstructure above the ground surface, comprising the steps of:

forming a plurality of vertical holes in the ground in a predetermined spaced-apart relation;

pouring in place in each hole an elongate concrete pier element provided with a vertically extending body and a first connecting element that extends longitudinally out of the uppermost end of the body and upward above the ground surface;

mounting upon the uppermost end of the body of each pier element a hollow member having opposed open ends, the hollow member being mounted to the pier member with the open ends in generally overlying relation to one another, generally in axial alignment with the pier element, and with the first connecting element contained within the hollow member;

mounting upon the hollow member of at least every two of the respective pier elements an elongate precast concrete beam having at least two, longitudinally spaced apertures, each one of the apertures being positioned to vertically overlie the hollow member of each respective pier element therebeneath, the minimum distance between opposing portions of the internal surface of each hollow member being substantially greater than the cross-sectional area of the aperture of beam thereabove;

inserting into each aperture and underlying hollow member a second connecting element that is positioned to extend vertically between the interiors of the hollow member and aperture; and filling the aperture and underlying hollow member with a bonding material to thereby bond each pier element and hollow member to the beam mounted thereon.

5. The method of constructing a support foundation of claim 4 wherein, following the mounting of the hollow member, the method includes the step of:

positioning each of the uppermost peripheries of each of the hollow members in coplanar relation with one another.

* * * * *